US007707844B2

(12) United States Patent
Nestler et al.

(10) Patent No.: US 7,707,844 B2
(45) Date of Patent: May 4, 2010

(54) THERMOSTATIC EXPANSION VALVE WITH BYPASS PASSAGE

(75) Inventors: David B. Nestler, St. Robert, MO (US); Mike Noble, St. Charles, MO (US)

(73) Assignee: Emerson Electric Co., St. Louis, MO (US)

( * ) Notice: Subject to any disclaimer, the term of this patent is extended or adjusted under 35 U.S.C. 154(b) by 918 days.

(21) Appl. No.: 11/357,632

(22) Filed: Feb. 17, 2006

(65) Prior Publication Data

US 2007/0194140 A1 Aug. 23, 2007

(51) Int. Cl.
*F25B 41/04* (2006.01)

(52) U.S. Cl. ..... 62/222; 62/225; 236/92 B

(58) Field of Classification Search ..... 236/92 B; 62/222, 225

See application file for complete search history.

(56) References Cited

U.S. PATENT DOCUMENTS

| | | | | | |
|---|---|---|---|---|---|
| 664,146 | A | | 12/1900 | Hackett | 137/533.25 |
| 919,155 | A | | 4/1909 | Giffen | 137/533.25 |
| 2,274,436 | A | | 2/1942 | Spence | 137/527.8 |
| 2,786,336 | A | * | 3/1957 | Lange | 62/212 |
| 3,154,096 | A | | 10/1964 | Miller | 137/1 |
| 3,292,658 | A | | 12/1966 | Domer | 137/527.2 |
| 3,699,778 | A | * | 10/1972 | Orth | 62/225 |
| 3,809,119 | A | | 5/1974 | Cave | 137/527.8 |
| 4,886,085 | A | | 12/1989 | Miler | 137/1 |
| 5,251,459 | A | | 10/1993 | Grass et al. | 137/539 |
| 6,354,510 | B1 | | 3/2002 | Petersen | 236/92 B |
| 6,658,877 | B2 | * | 12/2003 | Kjøng-Rasmussen | 62/222 |
| 6,691,924 | B1 | | 2/2004 | Vestergaard et al. | 236/92 B |

FOREIGN PATENT DOCUMENTS

| | | |
|---|---|---|
| CN | 2607484 Y | 3/2004 |
| JP | 2002 213635 | 7/2002 |

* cited by examiner

*Primary Examiner*—Frantz F Jules
*Assistant Examiner*—Azim Rahim
(74) *Attorney, Agent, or Firm*—Harness, Dickey & Pierce, P.L.C.

(57) ABSTRACT

A thermostatic expansion valve is provided comprising an inlet, an outlet, first and second flow paths through the valve, a first valve element in the first flow path between the inlet and outlet, and a movable diaphragm having a first side acted on by a first fluid pressure and a second side acted on by at least a second fluid pressure. The diaphragm is movable to permit increased flow through the first flow path when the force against the first side is greater than that against the second side, and is movable to restrict flow through the first flow path when the force against the first side is less than that against the second side. The diaphragm moves in an upward direction to cause the first valve element to close the first flow path, and may continue to move in the upward direction to cause a second flow path to open.

19 Claims, 5 Drawing Sheets

THERMOSTATIC EXPANSION VALVE WITH BYPASS PASSAGE

FIELD OF THE INVENTION

The present invention relates to thermostatic expansion valves for controlling the flow of refrigerant to an evaporator in an air conditioning system.

BACKGROUND OF THE INVENTION

Thermostatic expansion valves are used to control or meter the flow of refrigerant to an evaporator in an air conditioning system, to provide a refrigerant flow rate into the evaporator that approximately matches the refrigerant flow rate exiting the evaporator. The refrigerant flowing through the thermostatic expansion valve experiences an expansion and a drop in pressure, which results in a refrigerant vapor being supplied to the evaporator. The vapor is then superheated in the evaporator before it enters the suction inlet to the compressor of the air conditioning system.

The typical thermostatic expansion valve operates via a working fluid having a "charge" pressure that changes in response to sensing the temperature of the refrigerant suction line to the compressor. The working fluid pressure acts against a diaphragm in the thermostatic expansion valve to effect opening and closing of a valve. By controlling the refrigerant flow to the evaporator, the thermostatic expansion valve maintains a predetermined amount of superheat in the evaporator to ensure that only vapor is leaving the evaporator. If there is insufficient refrigerant or superheat in the evaporator, un-evaporated liquid refrigerant leaving the evaporator could enter the suction inlet to the compressor. Liquid refrigerant entering the suction inlet to the compressor could cause overheating or damage to the compressor.

SUMMARY OF THE INVENTION

The present invention relates to a thermostatic expansion valve that has a diaphragm for movably controlling a first valve element, which regulates fluid flow to the valve outlet. If a loss of charge pressure occurs due to a leak, for example, the loss of charge pressure against the diaphragm would cause the first valve element to move to a closed position and remain closed. An extended restriction of flow would lead to insufficient refrigerant in the evaporator and possible compressor damage. The present thermostatic expansion valve also has a bypass passage for allowing fluid flow to the outlet when the diaphragm moves in a direction to close the first valve element and continues to move beyond the point of closure by more than a predetermined distance, as would occur upon loss of charge pressure. In accordance with one aspect of the present invention, various embodiments of a thermostatic expansion valve are provided that comprise an inlet, an outlet, and a first valve element between the inlet and outlet, and a movable diaphragm. The diaphragm has a first side in communication with a pressurized fluid external to the thermostatic expansion valve, and a second side in communication with the pressurized fluid within the valve chamber outlet. In one embodiment, the diaphragm is movable relative to a neutral position in response to changes in pressure between the outlet fluid pressure and the external fluid pressure, wherein the movement of the diaphragm controls the first valve element to regulate the fluid flow rate through the valve. Various embodiments further comprise a second valve element in connection with the diaphragm, where the second valve element permits fluid flow from the inlet to the outlet through a bypass passageway when the diaphragm moves in a direction to close the first valve element and continues to move in the same direction more than a predetermined distance beyond the closure of the first valve.

In another aspect of the present invention, another embodiment of a thermostatic expansion valve is provided that comprises an inlet, an outlet, first and second flow paths through the valve, a first valve element in the first flow path between the inlet and outlet, and a movable diaphragm having a first side acted on by a first fluid pressure and a second side acted on by at least a second fluid pressure. The diaphragm is movable relative to a neutral position in response to changes in the pressures against the first and second sides of the diaphragm, wherein the diaphragm movement controls the position of the first valve element to regulate the fluid flow through the first flow path. This embodiment further comprises a spring for biasing the first valve element towards a closed position. The diaphragm is movable to permit increased fluid flow through the first flow path when the force against the first side is greater than that against the second side, and is movable to restrict fluid flow through the first flow path when the force against the first side is less than that against the second side. The thermostatic expansion valve further comprises a second valve element in connection with the diaphragm for permitting fluid flow through a second flow path, when the diaphragm moves to close the first valve element and continues to move more than a predetermined distance beyond the closure of the first valve element.

In yet another aspect of the invention, other embodiments of an expansion valve are provided that permit fluid flow through the valve when an opening in a slidable valve element is slideably moved into the flow path between the inlet and the outlet of the valve. In one exemplary embodiment, the valve comprises a slideable valve element in the flow path between the inlet and outlet, the slidable valve element having first and second openings therein, each of which may be slidably moved into the flow path to permit fluid flow through to the outlet. The valve further comprises a spring for providing a force for biasing the slidable valve element against a moveable diaphragm, which has a first side acted on by a first fluid pressure and a second side acted on by a second fluid pressure and the spring biasing force. The diaphragm is movable relative to a neutral position in response to changes in the pressures against the first and second sides of the diaphragm, wherein the diaphragm movement controls the position of the first opening in the slide valve element relative to the flow path to regulate the fluid flow through the first valve opening. The diaphragm is movable in a first direction to increase fluid flow through the first opening in the slideable valve element when the force against the first side is greater than that against the second side, and is movable in a second direction to restrict fluid flow through the first opening in the slideable valve element when the force against the first side is less than that against the second side. A second opening in the slide valve element permits fluid flow from the inlet to the outlet when the diaphragm allows the slide valve element to move in the second direction to move the first opening out of the flow path to a restricted flow position and the second opening into the flow path.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

Corresponding reference numerals indicate corresponding parts throughout the several views of the drawings.

DETAILED DESCRIPTION OF THE EMBODIMENTS

The following description of the various embodiments are merely exemplary in nature and are in no way intended to limit the invention, its application, or uses.

Figure 1:
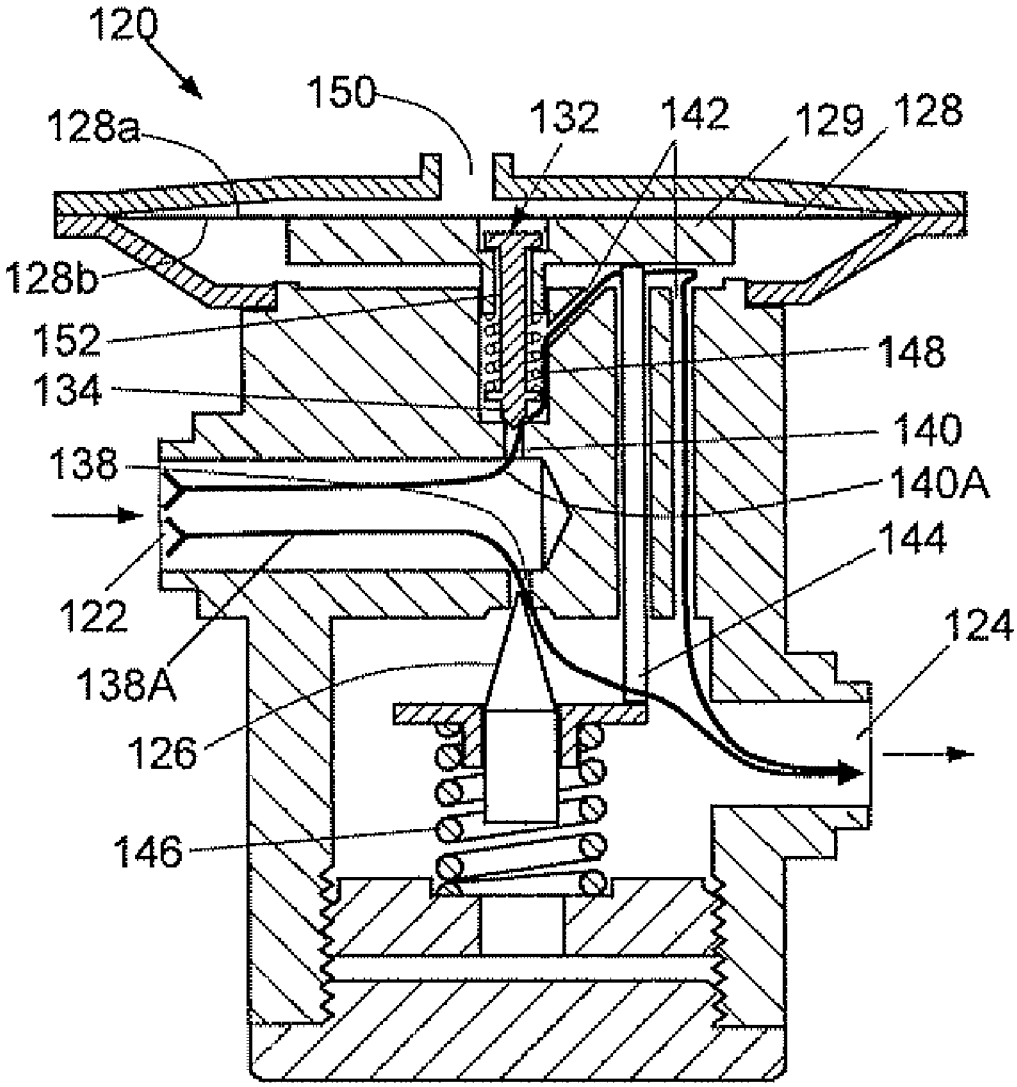
FIG. 1 is a cross-sectional side view of one embodiment of a thermostatic expansion valve in accordance to the principles of the present invention.
Figure 2:
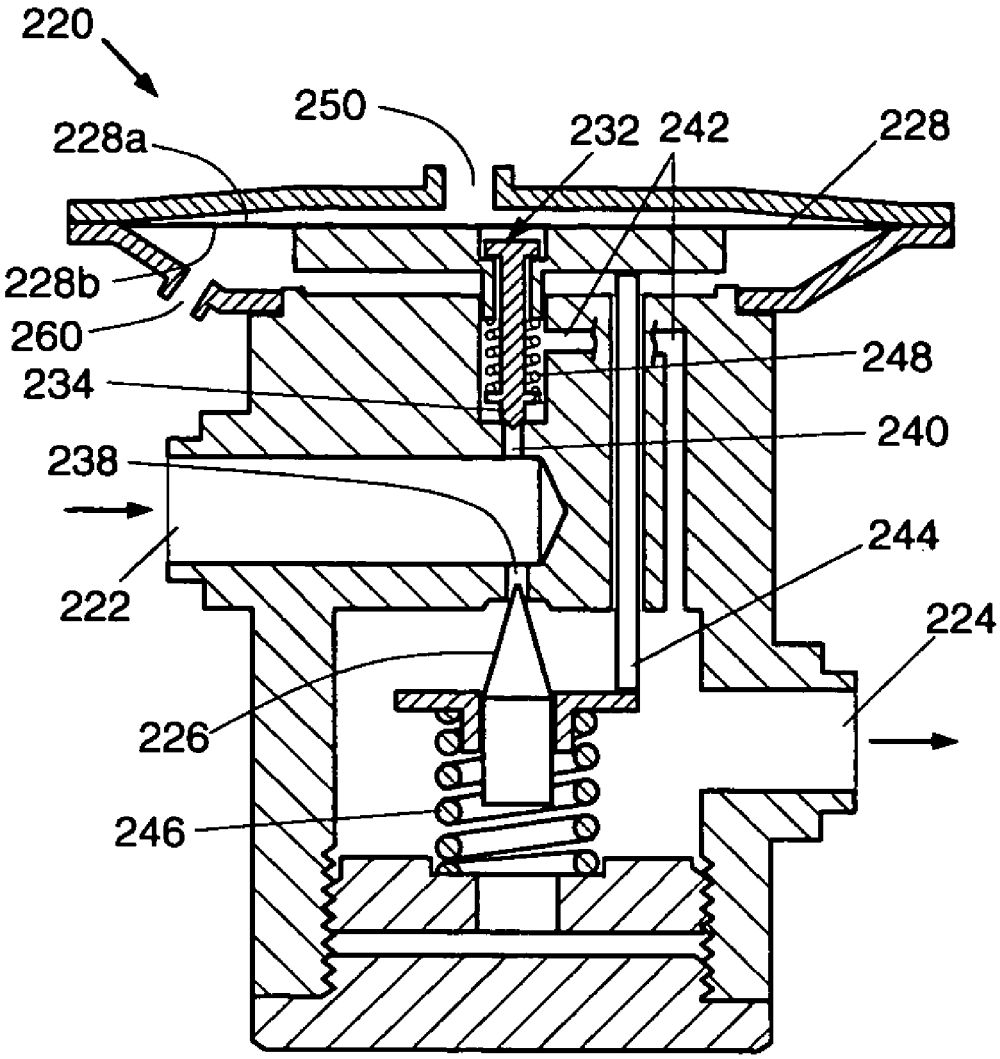
FIG. 2 is a cross-sectional side view of a second embodiment of a thermostatic expansion valve in accordance to the principles of the present invention.

One embodiment of a thermostatic expansion valve in accordance with the present invention is generally shown in FIG. 1 at 120. The thermostatic expansion valve 120 comprises an inlet 122, an outlet 124, a first valve element 126 between the inlet 122 and outlet 124, and a movable diaphragm 128. The movable diaphragm has a first side 128*a* in communication with a pressurized fluid 150 external to the thermostatic expansion valve, and a second side 128*b* in communication with the outlet 124. In the first embodiment, the diaphragm 128 is movable relative to a neutral position in response to changes in pressure between the outlet 124 and the external fluid pressure at 150, wherein the movement of the diaphragm 128 controls the first valve element 126 to regulate the fluid flow rate through the valve 120. The first embodiment further comprises a second valve element 134 in connection with the diaphragm 128, for permitting fluid flow to the outlet 124 through a second valve opening or bypass passageway 140 when the diaphragm 128 moves in a direction to close the first valve element 126 and continues to move in the same direction by more that a predetermined distance. In the first embodiment, the predetermined distance or stroke beyond the point of closure of the first valve which will open the second valve element is in the range of about 0.001 inches to about 0.010 inches.

Some embodiments of a thermostatic expansion valve further comprise an actuator member 144 for engaging the movable diaphragm 128 and the first valve element 126 to permit the movement of the diaphragm 128 to control the movement of the first valve element 126 to regulate the fluid flow through opening 138. A spring 146 provides a biasing force against the first valve element 126 to move the valve element 126 towards a closed position. The spring 146 also applies a biasing force via actuating member 144 to the second side 128*b* of the diaphragm 128, such that the spring biasing force and the force of the outlet fluid pressure both act against side 128*b* of the diaphragm. Thus, the diaphragm provides a balancing of the forces of the external fluid pressure acting against side 128*a*, and the spring biasing force and outlet fluid pressure acting against side 128*b*.

In the first embodiment, the diaphragm 128 is movable to displace a first valve element 126 to permit increased fluid flow through first valve opening 138 when the force against the first side 128*a* of the diaphragm 128 is greater than that against the second side 128*b*. The first valve element 126 is preferably a tapered needle valve disposed within the first valve opening 138, wherein movement of the tapered needle valve varies the cross-sectional area through the opening to allow for regulating fluid flow. Alternatively, the first valve element 126 may comprise a contoured poppet valve or other valve element disposed within the opening 138 that is suitable for varying or regulating the fluid flow. The first embodiment also includes a second valve element 134, which comprises a pin 132 that is slidably disposed within a cavity 152 in a buffer plate. The pin 132 and second valve element 134 are biased by a second spring 148 against the second valve opening 140 of a bypass passageway 142 relative to the buffer plate 129. Accordingly, when upward movement of the buffer plate 129 is not restricted or prevented by the diaphragm 128, the biasing spring 148 expands such that the pin/second valve element 134 is no longer biased against the second valve opening 140. The second valve element 134 (and pin 132) is biased in a closed position against the bypass opening 140 when the diaphragm downwardly displaces the first valve element 126 to permit fluid flow through first valve opening 138 to the exit 124. Thus, there is no fluid flow through the bypass passageway 142 when the first valve element 126 permits fluid flow through the first valve opening 138 to the valve exit 124.

The working fluid at 150 functions to apply an effective amount of pressure against side 128*a* of the diaphragm, so as to move the diaphragm 128 in a direction for opening the first valve element 126. A force is applied against side 128*b* of the diaphragm by the pressure of the fluid internal to the valve 120, which is in communication with the exit 124 of the thermostatic expansion valve 120. A biasing force is also applied against side 128*b* of the diaphragm by the spring 146 when the first valve element 126 is in an open position relative to the first valve opening 138. Thus, the force applied against side 128*a* by the working fluid must be greater than the force applied against side 128*b* by the internal fluid pressure and the spring 146 for the diaphragm to move the first valve element 126 to an open position. When the force against the first side 128*a* is greater than that against the second side 128*b*, the diaphragm 128 is movable in a first direction to permit increased fluid flow through the first valve opening 138. When the force against the first side 128*a* is less than that against the second side 128*b*, the diaphragm 128 is movable in a second direction to cause the first valve element 126 to restrict fluid flow through the first valve opening 138. Fluid flow is completely restricted when the diaphragm 128 moves in the second direction to allow the valve element 126 to completely close against the first valve opening 138. The diaphragm may continue to move in the second direction beyond the closure point if the force against side 128*a* is less than the force of the internal fluid pressure acting against side 128*b*. Such a situation could occur where a leak or loss of pressure in the external pressure source causes a loss of charge pressure. In this situation, pressure against side 128*b* may move the diaphragm 128 in the second direction beyond the point of closure of the first valve element 126, to permit the second valve element 134 to open relative to a bypass or second valve opening 140. Specifically, when the diaphragm 128 is displaced more than a predetermined distance beyond the position of closure of the first valve element 126, the buffer plate 129 is no longer restricted by the diaphragm and moves upward by virtue of the second spring 148. The second spring 148 accordingly expands and removes the spring force holding the second valve element 134 closed. The fluid pressure at 122 and opening 140 causes the second valve element 134 to move upward to an open position. Thus, the diaphragm 128 is movable to control a first valve element 126 for regulating fluid flow through a first valve opening 138 to the exit 124, and is further movable upon closure of the first valve element 126 against opening 138 to open a second valve element 134 to permit fluid flow to the exit 124 though a bypass opening 142 when the diaphragm 128 is displaced more than a predetermined distance beyond the point of closure of the first valve element 126.

The working fluid pressure 150 in communication with the first side 128*a* of the diaphragm 128 is provided by a pressurized fluid from an external device, such as a capillary tube having a working fluid pressure that is generally higher than the internal fluid pressure or pressure at the exit of the valve. The capillary tube or bulb may be positioned adjacent to the refrigerant suction line of a compressor in a typical air conditioning system, and provides a working pressure that is responsive to the temperature of the refrigerant suction line to the compressor. The bulb pressure varies with suction line temperature changes and acts against the diaphragm 128 to effect opening and closing of the valve element 126 against a spring bias and an equilibrium pressure against side 128*b* of the diaphragm. By sensing the suction line temperature and controlling the refrigerant flow through the valve exit 124 to the evaporator, the thermostatic expansion valve 120 maintains a predetermined amount of superheat in the evaporator of the air conditioning system. During normal operation of an air conditioning system, it is possible that a loss of working fluid pressure could occur, due to a leak in the capillary tube or a rupture in the diaphragm 128. In such a situation, the loss of pressure against the diaphragm 128 leads to a force against side 128*a* that is less than the force against side 128*b* resulting in closure of the valve element 126 against the first valve opening 138. This blocks the flow of refrigerant to the evaporator of the air conditioning system, which could lead to low suction pressure, and an inadequate superheat in the evaporator entering the suction inlet to the compressor. Such a situation could cause overheating or damage to the compressor, and is especially of concern for high efficiency scroll compressors.

In the event of a loss of working pressure, where fluid flow is completely restricted when the diaphragm 128 moves the valve element 126 to a closed position, the force against side 128*a* is less than the force of the internal fluid pressure against side 128*b*. Thus, the diaphragm 128 moves in a direction for closing the first valve element 126 in the first flow path 138A, and continues to move in the same direction to open a second valve element 134 when the diaphragm is displaced more than a predetermined distance beyond the position of closure of the first valve element 126. The opening of the second valve element 134 relative to the bypass opening 140 in the second flow path 140A permits a predetermined flow of refrigerant through a passageway 142 to the valve outlet 124 and to the evaporator, to enable the air conditioning system to operate at a nominal level in the event of a loss of working pressure.

The bypass opening 140 and the passageway 142 are sized to provide a predetermined nominal flow rate for nominal operating conditions of a typical air conditioning system. This first embodiment of a thermostatic expansion valve provides control of fluid flow relative to changes in a working fluid pressure to regulate the amount of superheat in the evaporator, and also provides a predetermined amount of superheat in the event of a loss of working pressure for a limp along mode of air conditioning operation. The thermostatic expansion valve 120 accordingly provides protection to a compressor by ensuring an adequate level of suction pressure to prevent overheating or damage to the compressor.

In a second embodiment, a thermostatic expansion valve 220 is provided that comprises an inlet 222, an outlet 224, a first flow path 238 and second flow path 240 through the valve, a first valve element 226 in the first flow path between the inlet 222 and outlet 224, and a movable diaphragm 228 having a first side 228*a* acted on by a first fluid pressure and a second side 228*b* acted on by at least a second fluid pressure. The diaphragm 228 is movable relative to a neutral position in response to changes in the pressures against the first and second sides 228*a* and 228*b* of the diaphragm, wherein the diaphragm movement controls the position of the first valve element 226 to regulate the fluid flow through the first flow path 238. The second embodiment further comprise a spring 246 for biasing the first valve element 226 towards a closed position. The diaphragm 228 is movable to permit increased fluid flow through the first flow path 238 when the force against the first side 228*a* is greater than that against the second side 228*b*, and is movable to restrict fluid flow through the first flow path 238 when the force against the first side 228*a* is less than that against the second side 228*b*. The second embodiment of a thermostatic expansion valve 220 further comprise a second valve element 234 in connection with the diaphragm 228 for permitting fluid flow from the inlet 222 to the outlet 224 through a second flow path 240 only when the first valve element 226 is in a closed position. The second valve element 234 is biased in a closed position against the bypass opening 240 whenever the diaphragm 228 has displaced the first valve element 226 to permit fluid flow through the first valve opening 238 to the exit 224. Thus, there is no fluid flow through the bypass or second valve passageway 242 when the first valve element 226 permits fluid flow through the first valve opening 238 and the valve exit 224. The diaphragm 228 may also continue to move beyond closure of the first valve element 226 if the force against side 228*a* is less than the force of the internal fluid pressure against side 228*b*. In this situation, the diaphragm 228 moves in the direction to close the first valve element 226, and continues to move in the same direction allowing the second valve element 234 to open when the diaphragm 228 is further displaced beyond the point of closure of the first valve element 226 by more than a predetermined distance.

In the second embodiment, the second fluid pressure is provided by a pressurized fluid from an external source, such as the outlet of the evaporator, to provide an externally equalized pressure rather than an internal fluid pressure to side 228*b* of the diaphragm. In this second embodiment, the diaphragm moves relative to changes between the working fluid pressure at 250 that is responsive to the suction line temperature, and changes in the pressure drop across the evaporator at inlet 260. Thus, this embodiment provides diaphragm control of a first valve element to regulate refrigerant flow in response to relative pressure changes external to the valve, and also provides a predetermined amount of flow in the event of a loss of working pressure for a limp along mode of air conditioning operation. The thermostatic expansion valve 220 accordingly provides protection to a compressor by ensuring an adequate level of suction pressure to prevent overheating or damage to the compressor.

Figure 3:
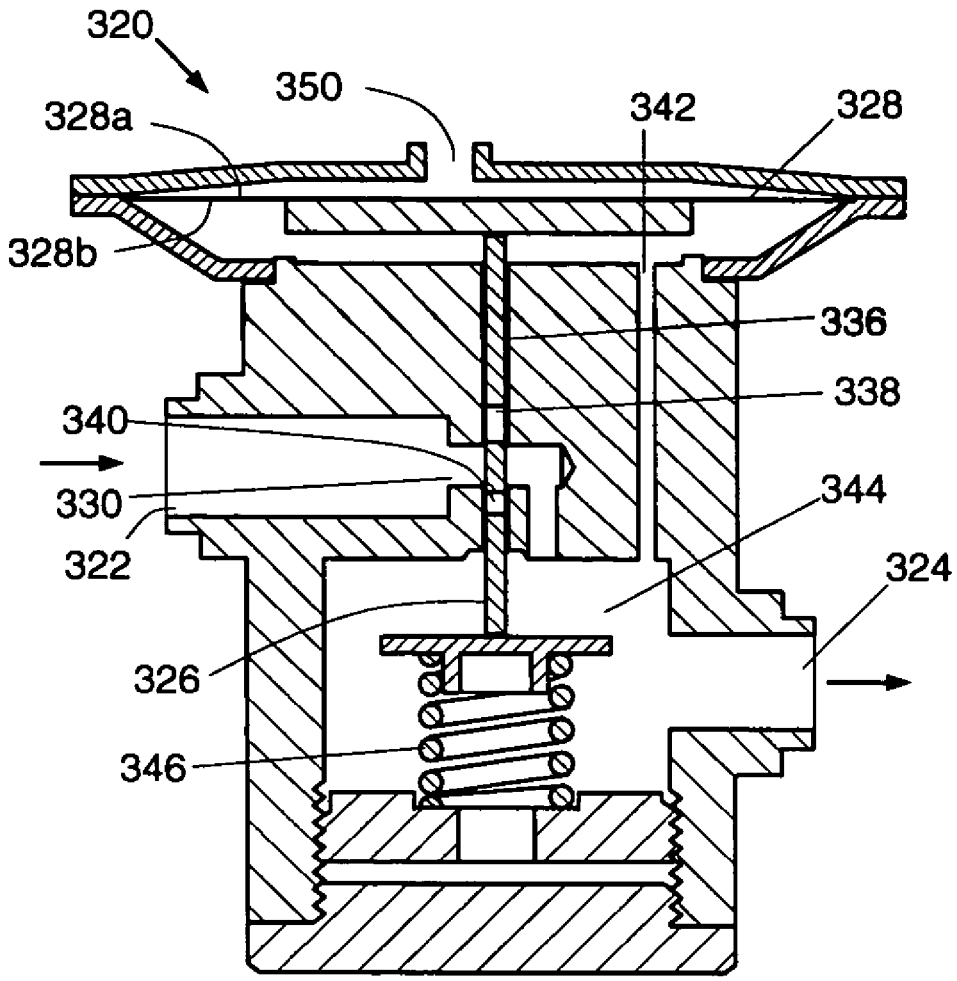
FIG. 3 is a cross-sectional side view of a third embodiment of a thermostatic expansion valve in accordance to the principles of the present invention.

Referring to FIG. 3, a third embodiment of a thermostatic expansion valve is shown. The thermostatic expansion valve 320 comprises an inlet 322, an outlet 324, a slide valve element 326 between the inlet chamber 322 and outlet chamber 324, and a movable diaphragm 328. The movable diaphragm has a first side 328*a* in communication with a pressurized fluid 350 external to the thermostatic expansion valve, and a second side 328*b* in communication with the outlet 324 via passage 342. The diaphragm 328 is movable relative to a neutral position as shown in FIG. 3, in response to changes in pressure between the outlet 324 and the external fluid pressure 350. The movement of the diaphragm 328 regulates the fluid flow rate through the valve 320, by controlling or positioning a first valve opening port 338 in the slide valve element 326 relative to the opening 330 in the inlet chamber. The slide valve element 326 further comprises a second valve opening or bypass port 340 that permits fluid flow from the inlet 322 to the outlet 324 when the diaphragm 328 moves against the fluid pressure acting on side 328*a* to the extent that the slide valve element 326 moves the first valve opening port 338 to a closed position and further moves in the same direction by more than a predetermined distance.

In the third embodiment, the slide valve element 326 also acts as an actuator member for engaging the movable diaphragm 328 and a spring 346, which permits the balancing of the spring force and the force against the diaphragm 328 to control the movement of the first opening port 338 in the slide valve element 326 to regulate the fluid flow through opening 330. The spring 346 provides a biasing force against the slide valve element 326 to move the first opening port 338 towards a closed position away from the opening 330 in the inlet chamber. The spring 346 also applies a biasing force via the slide valve element 326 to the second side 328*b* of the diaphragm 328, such that the spring biasing force and the outlet fluid pressure both act against side 328*b* of the diaphragm. Thus, the diaphragm provides a balancing of the forces of the external fluid pressure acting against side 328*a*, and the spring biasing force and outlet fluid pressure acting against side 328*b*.

In the third embodiment, the diaphragm 328 is movable to move the first opening port 338 in the slide valve element 326 into the opening 330 to permit increased fluid flow through the opening 30 when the force against the first side 328*a* of the diaphragm 328 is greater than that against the second side 328*b*. The slide valve element 326 is preferably a plate having first and second ports that are disposed within a slot 336, wherein movement of the first port opening 338 into the opening 330 varies the cross-sectional area through the opening 330 to regulate the flow of fluid. For manufacturing convenience, the opening 330 in the inlet chamber and the opening port 338 in the slide plate 326 are preferably generally circular openings. Alternatively, the opening 330 in the inlet chamber and the first opening port 338 in the slide plate 326 may comprise a rectangular, oval, or tapered or contoured opening shape suitable for varying the cross-sectional area of an opening 330 to regulate the fluid flow through the valve 320. The slide valve element 326 also includes a second opening or bypass port 340, which may be a generally circular or rectangular opening. Alternatively, the second opening port 340 in the slide plate 326 may comprise a rectangular, oval, or tapered or contoured opening shape suitable for varying the cross-sectional area of an opening 340 to regulate the fluid flow through the valve 320. The second opening port 340 is biased in a closed position when the force against the first side 328*a* of the diaphragm 328 is greater than that against the second side 328*b*. Thus, there is no fluid flow through the second bypass opening port 340 when the first opening port 338 is within the opening 330 to permit fluid flow to the valve exit 324. The second opening port 340 moves into the opening 330 of the inlet chamber when the force against the first side 328*a* of the diaphragm 328 is significantly less than the force against the second side 328*b*, such that upward movement of the diaphragm 328 allows the slide valve element 326 to move the first opening port 338 to a closed position and to further move in the same direction by more than a predetermined distance.

The working fluid at 350 functions to apply an effective amount of pressure against side 328*a* of the diaphragm, so as to move the diaphragm 328 in a direction for moving the first opening 338 in the slide valve element 326 to an open position. A force is applied against side 328*b* of the diaphragm by the pressure of the fluid internal to the valve 320, which is in communication with the exit 324 via passage 342. A biasing force is also applied against side 328*b* of the diaphragm by a spring 346 via the slide valve element 326. Thus, the force applied against side 328*a* by the working fluid must be greater than the force applied against side 328*b* by the internal fluid pressure and the spring 346 for the diaphragm to move the first port opening 338 in the slide valve element 326 to an open position relative to opening 330. When the force against the first side 328*a* is greater than that against the second side 328*b*, the diaphragm 328 is movable in a first direction to permit increased fluid flow through opening 330 via the first opening port 338. When the force against the first side 328*a* is less than that against the second side 328*b*, the diaphragm 328 is movable in a second direction to restrict fluid flow through opening 330. Fluid flow is completely restricted when the diaphragm 328 moves the slide valve element 326 in the second direction to the extent that the first opening port 338 is moved out of the opening 330 to close the opening passage 330. The diaphragm 328 may continue to move in the second direction beyond the point of port 338 moving to a closed position, if the force against side 328*a* is less than the spring force and force of the internal fluid pressure against side 328*b*. In this situation, the diaphragm 328 may continue to move in the second direction to the extent that the second bypass opening port 340 in the slide valve element 326 moves into the opening 330 when the diaphragm is displaced more than a predetermined distance beyond the position of port 338 moving to a closed position. Thus, the diaphragm 328 is movable to control a first opening port 338 for regulating fluid flow through opening 330 to the exit 324, and is further movable upon closure of the first opening port 338 to open a second bypass port 340 to permit fluid flow to the exit 324 when the diaphragm 328 is displaced more than a predetermined distance beyond the position of port 338 moving to a closed position.

The working fluid pressure 350 in communication with the first side 328*a* of the diaphragm 328 is provided by a pressurized fluid from an external device, such as a capillary tube having a working fluid pressure that is generally higher than the internal fluid pressure or pressure at the exit of the valve. The capillary tube or bulb may be positioned adjacent to the refrigerant suction line of a compressor in a typical air conditioning system, and provides a working pressure that is responsive to the temperature of the refrigerant suction line to the compressor. The bulb pressure varies with suction line temperature changes and acts against the diaphragm 328 to effect opening and closing of the first valve opening port 338, against a spring bias and an equilibrium pressure against side 328*b* of the diaphragm. By sensing the suction line temperature and controlling the refrigerant flow through the valve exit 324 to the evaporator, the thermostatic expansion valve 320 maintains a predetermined amount of superheat in the evaporator of the air conditioning system. During normal operation of an air conditioning system, it is possible that a loss of working fluid pressure could occur, due to a leak in the capillary tube or a rupture in the diaphragm 328. In such a situation, the loss of pressure against the diaphragm 328 leads to a force against side 328*a* that is less than the force against side 328*b* resulting in an upward movement of the diaphragm that moves the first opening port to a closed position. If the flow of refrigerant to the evaporator of the air conditioning system were closed off, this could lead to low suction pressure, and an inadequate superheat in the evaporator entering the suction inlet to the compressor. The situation of low suction pressure entering the suction inlet to the compressor could cause overheating or damage to the compressor, and is especially of concern for high efficiency scroll compressors.

In the above situation of a loss of working pressure, where the diaphragm 328 moves the first opening port 338 in the slide valve element 326 to a closed position, the force against side 328*a* is less than the force of the internal fluid pressure against side 328*b*. Upon a loss of working fluid pressure at 350, the upward displacement of the diaphragm 328 allows the slide valve element 326 to move in a direction for shifting the first opening port 338 upward to a closed position, and to further move in the same direction by more than a predetermined distance that is sufficient to cause the second bypass port 340 to move into the opening 330 to permit fail-safe fluid flow through the second opening. The movement of the second bypass opening port 340 relative to the opening 330 permits a predetermined flow of refrigerant through the second bypass port 340 to the valve outlet 324 and to the evaporator, to enable the air conditioning system to operate at a nominal level in the event of a loss of working pressure.

Figure 4:
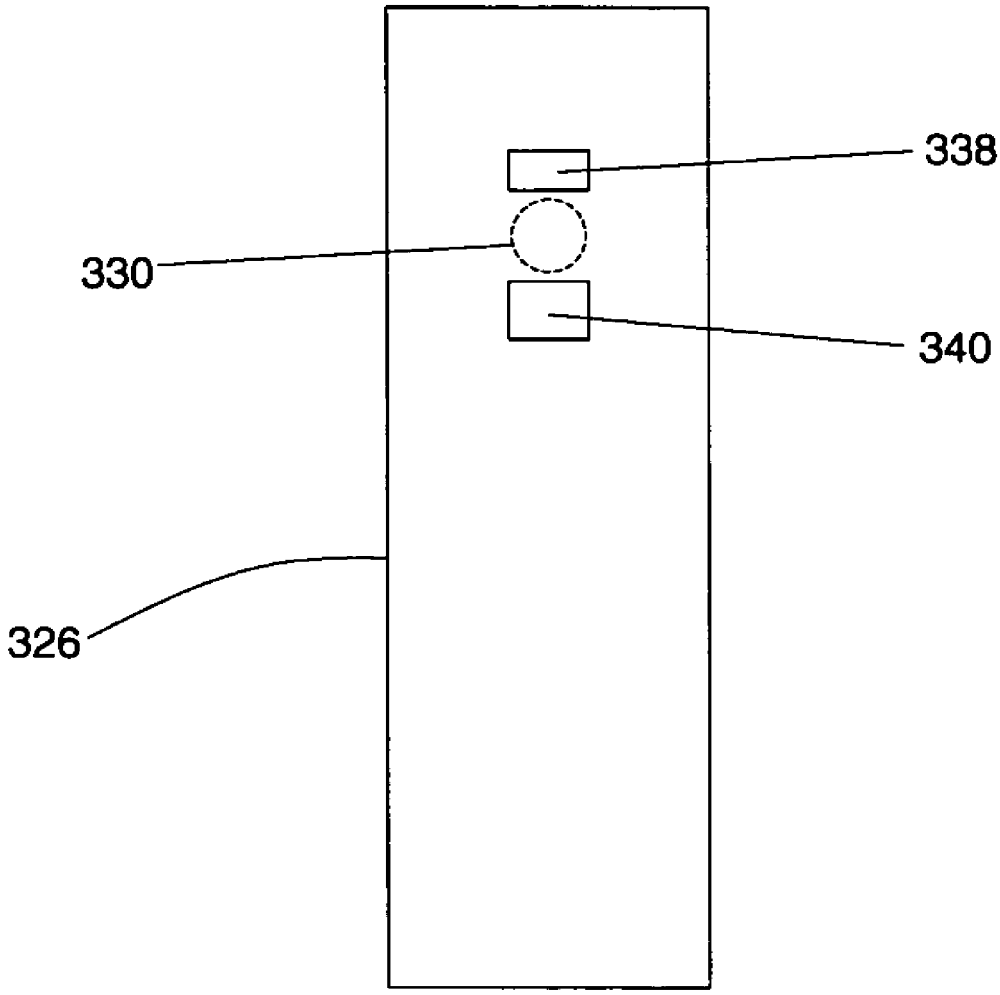
FIG. 4 is a side view of a slide valve element of the third embodiment of a thermostatic expansion valve according to the principles of the present invention.

As shown in FIG. 4, the first bypass opening port 338 and the second bypass opening port 340 are spaced apart from each other such that the distance from the bottom of the first port 338 to the top of the second port is at least greater than the height of the opening 330 of the inlet chamber. More preferably, the distance between the first port 338 and second port 340 is at least that of the opening 330, plus a predetermined distance the slide valve element 326 must move beyond the point of closure of the first opening port 338 to cause the second bypass port 340 to move into the inlet opening 330 for establishing a fail-safe open position. In the third embodiment, this predetermined distance is preferably in the range of about 0.001 to about 0.010 inches, but may alternatively comprise a greater predetermined distance in other valve embodiments. It should be noted that this predetermined distance may be scalable depending on the overall stroke distance of the valve.

The second bypass opening port 340 is sized to provide a predetermined nominal flow rate for nominal operating conditions of a typical air conditioning system. This third embodiment of a thermostatic expansion valve provides control of fluid flow relative to changes in a working fluid pressure to regulate the amount of superheat in the evaporator, and also provides a predetermined amount of superheat in the event of a loss of working pressure for a limp along mode of air conditioning operation. The thermostatic expansion valve 320 accordingly provides protection to a compressor by ensuring an adequate level of suction pressure to prevent overheating or damage to the compressor.

Figure 5:
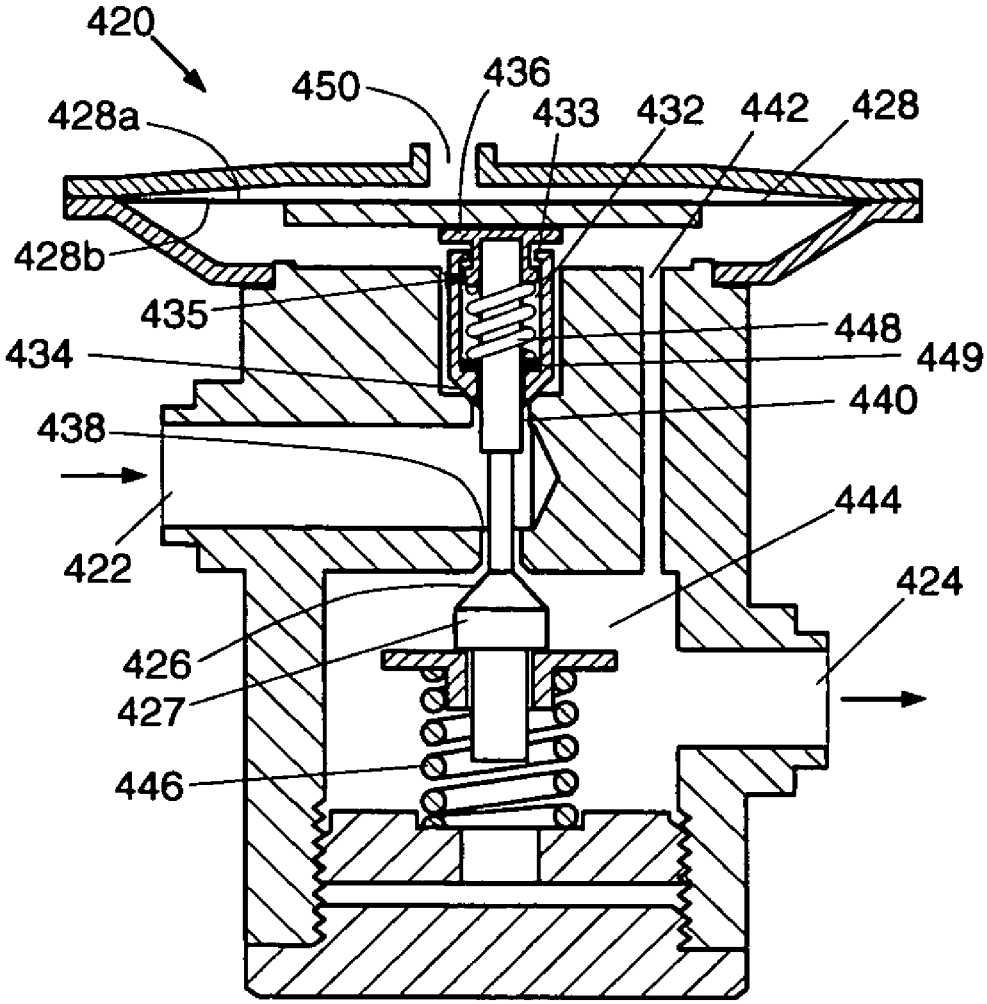
FIG. 5 is a side view of a fourth embodiment of a thermostatic expansion valve according to the principles of the present invention.

A fourth embodiment of a thermostatic expansion valve in accordance with the present invention is generally shown in FIG. 5 at 420. The thermostatic expansion valve 420 comprises an inlet 422, an outlet 424, a first valve element 426 between the inlet 422 and outlet 424, and a movable diaphragm 428. The movable diaphragm has a first side 428*a* in communication with a pressurized fluid 450 external to the thermostatic expansion valve, and a second side 428*b* in communication with the outlet 424. In the fourth embodiment, the diaphragm 428 is movable relative to a neutral position in response to changes in pressure between the outlet 424 and the external fluid pressure at 450, wherein the movement of the diaphragm 428 controls the first valve element 426 to regulate the fluid flow rate through the valve 420. The fourth embodiment further comprises a second valve element 432, for permitting fluid flow to the outlet 424 through a bypass passageway 440 when the diaphragm 428 moves upward in a direction to close the first valve element 426 and continues to move in the same direction by more than a predetermined distance, such as when a pressure loss occurs at 450.

The working fluid at 450 functions to apply an effective amount of pressure against side 428*a* of the diaphragm, so as to move the diaphragm 428 in a direction for opening the first valve element 426. The first valve element 426 generally comprises a tapered portion on the shaft 427 disposed within the first port opening 438, wherein movement of the first valve element 426 varies the cross-sectional area through the opening 438 to allow for regulating fluid flow. A force is applied against side 428*b* of the diaphragm by the pressure of the fluid internal to the valve 420, which is in communication with the exit 424 of the thermostatic expansion valve 420. A biasing force is also applied against side 428*b* of the diaphragm by the spring 446 and shaft 427 when the first valve element 426 is in an open position relative to the opening 438. Thus, the force applied against side 428*a* by the working fluid at 450 must be greater than the force applied against side 428*b* by the internal fluid pressure and the spring 446 for the diaphragm to move the first valve element 426 towards an open position. When the force against the first side 428*a* is greater than that against the second side 428*b*, the diaphragm 428 is movable in a first direction to permit increased fluid flow through the valve opening 438. When the force against the first side 428*a* is less than that against the second side 428*b*, the diaphragm 428 is movable in a second direction to restrict fluid flow through the valve opening 438. Fluid flow is completely restricted when the diaphragm 428 moves the valve element 426 in the second direction to close against the first valve port opening 438.

In the fourth embodiment of a valve 420, a buffer plate 436 is provided for distribution of force from shaft 427 against side 428*b* of the diaphragm 428. Slidably coupled to buffer plate 436 is a second valve element 434, having an opening 432 therein for receiving a spring 446 for biasing the second valve element 434 and towards the second valve port opening 440. The second valve element 434 is slidably coupled to the buffer plate 436 by virtue of a lip 433 on the second valve element 434 that retains the second valve element over a tab 435 on the buffer plate 436. The spring 448 urges the second valve element to extend away from the buffer plate 436, and the tab 435 on buffer plate 436 engages lip 433 on the second valve element 434 to limit the amount of extension. Alternatively, in place of the lip 433, the second valve element 434 may comprise a locking ring inserted into a groove, or other suitable means for engaging the tab or ring 435 on the buffer plate 436. The slidably coupled valve element 434 and buffer plate 436 permits the diaphragm 428 and buffer plate 436 to move relative to the stationary second valve element 434 for displacing the shaft, while permitting the second valve element to fully extend such that the second valve element 434 may move away from the second valve opening 440.

When the valve 420 is at or near equilibrium, the spring 446 biases the first valve element 426 on shaft 427 to a closed position against the first valve port opening 438, and pressure against diaphragm side 428*a* maintains buffer plate 436 against the end of shaft 427. In this position, a spring 448 biases the second valve element 434 towards a closed position against the second valve port opening 440. Accordingly, the valve 420 may restrict flow from the inlet 422 to the outlet 424. Increased pressure at 450 causes the diaphragm 428 to push down on buffer plate 436 and shaft 427 to open the first valve element 426 relative to port 438 as shown in FIG. 5. This permits regulation of fluid flow from the inlet 422 through the first valve opening 438 to the valve outlet 424. The second valve element 434 is maintained in a closed position against the second valve opening 440 by biasing spring 448. A seal 449 is also provided for sealing around the shaft 427 and the second valve element 434. Thus, there is no fluid flow through the bypass passageway 440 when the first valve element 426 permits fluid flow through the first valve opening 438 to the valve exit 424.

In the event of a loss of charge pressure at 450, spring 446 biases the first valve element 426 on shaft 427 to move upward to a closed position against the first valve port opening 438. However, with no pressure at 450, the internal pressure against side 428*b* will cause the diaphragm 428 to continue to move in an upward direction. This allows spring 448 to extend until the tab 435 on buffer plate 436 engages lip 433 on the second valve element 434. The pressure at inlet 422 and at the second valve port opening 440 acting against the second valve element 434 will cause the second valve element 434 to continue to move the diaphragm 428 in an upward direction (since there is no opposing pressure at 450). This permits fluid flow from the inlet 422 through the second bypass valve opening 440 to the valve outlet 424. Thus, the diaphragm 428 moves in a direction to close the first valve element 426, and continues to move in the same direction to open the second valve element 434 when the diaphragm 428 is further displaced beyond the point of closure of the first valve element 426 by more than a predetermined distance. The opening of the second valve element 434 relative to the second valve opening 440 permits a predetermined flow of refrigerant through the bypass passageway 440 to the valve outlet 424 and to the evaporator, to enable the air conditioning system to operate at a nominal level in the event of a loss of working pressure.

The bypass port opening 440 and passageway are sized to provide a predetermined nominal flow rate for nominal operating conditions of a typical air conditioning system. This fourth embodiment of a thermostatic expansion valve provides control of fluid flow relative to changes in a working fluid pressure to regulate the amount of superheat in the evaporator, and also provides a predetermined amount of superheat in the event of a loss of working pressure for a limp along mode of air conditioning operation. The thermostatic expansion valve 420 accordingly provides protection to a compressor by ensuring an adequate level of suction pressure to prevent overheating or damage to the compressor.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A thermostatic expansion valve for controlling fluid flow comprising:

an inlet, an outlet, and a first valve element disposed within a first valve opening between the inlet and outlet;

a movable diaphragm having a first side in communication with a pressurized fluid external to the thermostatic expansion valve and a second side in communication with the outlet, the diaphragm being movable relative to a neutral position in response to changes in pressure between the outlet fluid pressure and the external fluid pressure, wherein the movement of the diaphragm controls the first valve element to regulate the fluid flow rate through the valve; and a second valve element disposed within a second valve opening between the inlet and the outlet, wherein the second valve element is coupled with the diaphragm, such that the second valve element is configured to be moved by the diaphragm away from the second valve opening for permitting fluid flow from the inlet through the second valve opening and a bypass passageway to the outlet;

wherein the diaphragm is configured to respond to a force against the first side of the diaphragm that is less than the force against the second side by moving the first valve element to a closed position against the first valve opening and moving the second valve element away from the second valve opening so as to restrict fluid flow through the first valve opening to the outlet and permit fluid flow through the second valve opening to the outlet.

2. The thermostatic expansion valve of claim 1 further comprising an actuator member for engaging the movable diaphragm and the first valve element to permit the movement of the diaphragm to control the movement of the first valve element to regulate the fluid flow through the valve.

3. The thermostatic expansion valve of claim 2 further comprising a spring for biasing the first valve element towards a closed position, wherein the spring biasing force is applied to the second side of the diaphragm while the first valve element is open.

4. The thermostatic expansion valve of claim 3 wherein the diaphragm is movable to increase fluid flow through the valve when the force against the first side of the diaphragm is greater than against the second side, and to restrict fluid flow through the valve when the force against the first side is less than against the second side.

5. The thermostatic expansion valve of claim 1 wherein the second valve element comprises a pin that is slidable relative to the second valve opening that is in communication with a bypass passageway, and is biased by a second spring against the second valve opening that is in communication with the bypass passageway, wherein the diaphragm allows the pin to move away from the second valve opening that is in communication with the bypass passageway when the diaphragm is displaced upwardly by more than a predetermined amount beyond the point of closure of the first valve element.

6. A thermostatic expansion valve for controlling fluid flow comprising:

an inlet, an outlet, and a first valve element disposed within a first valve opening between the inlet and outlet;

a movable diaphragm for controlling the first valve element, the diaphragm having a first side acted on by a first fluid pressure and a second side acted on by at least a second fluid pressure, the diaphragm being movable to position the first valve element to increase fluid flow through the valve first valve opening when the force against the first side is greater than that against the second side and to move the first valve element towards a closed position against the first valve element to restrict fluid flow through the first valve opening when the force against the first side is less than that against the second side; and a second valve element disposed within a second valve opening between the inlet and the outlet, wherein the second valve element is in connection with the diaphragm, the second valve element being configured to be moved by the diaphragm away from the second valve opening to permit fluid flow through the second valve opening and a bypass passage to the outlet, wherein the diaphragm is configured to respond to a force against the first side of the diaphragm is less than the force against the second side by moving the first valve element to a closed position against the first valve opening and moving the second valve element away from the second valve opening so as to restrict fluid flow through the first valve opening to the outlet and permit fluid flow through the second valve opening to the outlet.

7. The thermostatic expansion valve of claim 6 further comprising an actuator member for engaging the movable diaphragm and the first valve element to permit the movement of the diaphragm to control the movement of the first valve element to regulate the fluid flow through the valve.

8. The thermostatic expansion valve of claim 7 further comprising a spring for biasing the first valve element towards a closed position, wherein the spring biasing force is applied to the second side of the diaphragm while the first valve element is open.

9. The thermostatic expansion valve of claim 6 wherein the second side of the diaphragm is acted on by both a second fluid pressure and a spring force.

10. The thermostatic expansion valve of claim 6 wherein the second valve element comprises a pin that is slidable relative to the second valve opening that is in communication with a bypass passageway, and is biased by a second spring against the second valve opening that is in communication with the bypass passageway, wherein the diaphragm allows the pin to move away from the second valve opening that is in communication with the bypass passageway when the diaphragm is displaced upwardly by more than a predetermined amount beyond the point of closure of the first valve element.

11. A thermostatic expansion valve for controlling fluid flow and a bypass passage to the outlet comprising:

an inlet, an outlet, and a first valve element disposed within a first valve opening between the inlet and outlet;

a movable diaphragm having a first side in communication with a fluid pressure source external to the thermostatic expansion valve and a second side in communication with the outlet, the diaphragm being movable relative to a neutral position in response to changes in the pressures against the first and second sides of the diaphragm for regulating fluid flow through the first valve opening, wherein the diaphragm is movable to position the first valve element to permit increased fluid flow through the first valve opening when the force against the first side is greater than that against the second side, and is movable to move the first valve element towards a closed position against the first valve element to restrict fluid flow through the first valve opening when the force against the first side is less than that against the second side;

a spring for biasing the first valve element towards a closed position; and a second valve element disposed within a second valve opening between the inlet and the outlet, wherein the second valve element is engagable by the diaphragm such that the second valve element is configured to be moved away from the second valve opening by the diaphragm to permit fluid flow through the second valve opening;

wherein the diaphragm is configured to respond to a force against the first side of the diaphragm that is less than the force against the second side by moving the first valve element to a closed position against the first valve opening and moving the second valve element away from the second valve opening so as to restrict fluid flow through the first valve opening to the outlet and permit fluid flow through the second valve opening to the outlet.

12. The thermostatic expansion valve of claim 11 further comprising an actuator member for engaging the movable diaphragm and the first valve element to permit the movement of the diaphragm to control the movement of the first valve element to regulate the fluid flow through the valve.

13. The thermostatic expansion valve of claim 12 wherein the spring biasing force is further applied to the second side of the diaphragm through the actuator member.

14. The thermostatic expansion valve of claim 11 wherein the second side of the diaphragm is acted on by a second fluid pressure and a spring force.

15. The thermostatic expansion valve of claim 11 wherein the second valve element comprises a pin that is slidable relative to the second valve opening that is in communication with a bypass passageway, and is biased by a second spring against the second valve opening that is in communication with the bypass passageway, wherein the diaphragm allows the pin to move away from the second valve opening that is in communication with the bypass passageway when the diaphragm is displaced upwardly by more than a predetermined amount beyond the point of closure of the first valve element.

16. A thermostatic expansion valve for controlling fluid flow comprising:

an inlet, an outlet, a first valve seat between the inlet and outlet defining a first flow path, and a second valve seat between the inlet and the outlet defining a second flow path in parallel with the first flow path;

a first valve member movable relative to the first valve seat between the inlet and outlet;

a spring for biasing the first valve member towards a closed position against the first valve seat;

a movable diaphragm having a first side acted on by a first fluid pressure and a second side acted on by at least a second fluid pressure, the diaphragm being movable relative to a neutral position in response to changes in the forces against the first and second sides of the diaphragm to control the position of the first valve member for regulating the fluid flow through the first valve seat, wherein the diaphragm is movable to position the first valve member to permit increased fluid flow through the first valve seat when the force against the first side is greater than that against the second side, and is movable to move the first valve member towards the closed position against the first valve seat to restrict fluid flow through the first valve seat when the force against the first side is less than that against the second side; and a second valve member that is normally closed against the second valve seat, the second valve member having a surface that is engagable by the diaphragm, such that the second valve member is configured to be moved by the diaphragm away from the second valve seat to permit fluid flow through the second valve seat and a bypass passage to the outlet;

wherein the diaphragm is configured to respond to a force against the first side of the diaphragm that is less than the force against the second side by moving the first valve member to a closed position against the first valve seat and moving the second valve member to an open position away from the second valve seat, such that the first valve member restricts fluid flow through the first valve opening defining the first flow path to the outlet, and the second valve member permits fluid flow through the second valve opening defining the second flow path to the outlet.

17. The thermostatic expansion valve of claim 16 wherein the second valve member is engaged by a buffer member that is moved upwardly when the diaphragm moves in an upward direction more than a predetermined distance beyond the point of closure of the first valve member against the first valve seat.

18. The thermostatic expansion valve of claim 17 further comprising a spring for biasing the second valve member to a normally closed position against the second valve seat, which biasing force is removed when the buffer member engages the surface on the second valve member to cause the second valve member to move to an open position relative to the second valve seat.

19. The thermostatic expansion valve of claim 16 wherein the first fluid pressure acting on the first side of the diaphragm is provided by a capillary tube external to the thermostatic expansion valve, and the diaphragm moves in an upward direction to engage the surface on the second valve member for moving the second valve member to an open position when there is a loss of pressure acting against the first side of the diaphragm.

* * * * *